US008505317B2

(12) United States Patent
Ascani

(10) Patent No.: US 8,505,317 B2
(45) Date of Patent: Aug. 13, 2013

(54) REFRIGERATING DEVICE AND METHOD FOR CIRCULATING A REFRIGERATING FLUID ASSOCIATED WITH IT

(75) Inventor: Maurizio Ascani, Perugia (IT)

(73) Assignee: Angelantoni Life Science SRI, Massa Martana (IT)

( * ) Notice: Subject to any disclaimer, the term of this patent is extended or adjusted under 35 U.S.C. 154(b) by 732 days.

(21) Appl. No.: 12/601,060

(22) PCT Filed: May 22, 2007

(86) PCT No.: PCT/IT2007/000360

§ 371 (c)(1),
(2), (4) Date: Nov. 20, 2009

(87) PCT Pub. No.: WO2008/142714

PCT Pub. Date: Nov. 27, 2008

(65) Prior Publication Data

US 2010/0162740 A1 Jul. 1, 2010

(51) Int. Cl.
*F25B 1/00* (2006.01)
*F25B 5/00* (2006.01)
*F25B 9/00* (2006.01)

(52) U.S. Cl.
USPC ..... 62/116; 62/115; 62/117; 62/498; 62/500; 62/87; 62/172

(58) Field of Classification Search
USPC ..... 62/115–117, 498, 500, 87, 172
See application file for complete search history.

(56) References Cited

U.S. PATENT DOCUMENTS 4,218,891 A * 8/1980 Schwartzman ..... 62/116
4,896,515 A * 1/1990 Endou ..... 62/498
5,347,823 A 9/1994 Alsenz
6,070,421 A 6/2000 Petrovich et al.
6,113,358 A 9/2000 Young et al.
6,321,564 B1 * 11/2001 Yamanaka et al. ..... 62/510

(Continued)

FOREIGN PATENT DOCUMENTS

EP 0239680 10/1987
EP 0845642 A2 6/1998

(Continued)

OTHER PUBLICATIONS

PCT International Search Report for PCT/IT2007/000360 mailed Aug. 31, 2009.

*Primary Examiner* — Frantz F. Jules
*Assistant Examiner* — Joseph Trpisovsky
(74) *Attorney, Agent, or Firm* — Perkins Coie LLP

(57) ABSTRACT

Refrigerating device formed by a main compressor (190), a condenser (140) downstream of and in fluid communication with the main compressor (190), main expansion means (170) downstream of the condenser (140) and an evaporator (180) downstream of and in fluid communication with the main expansion means (170), which also comprises a turbocompressor unit (160) in fluid communication between the evaporator (180) and the main compressor (190) and a heat exchanger (150, 152) having a hot branch (150*c*) connected upstream, via an inlet line (145), to the condenser (140) and downstream, via an outlet line (149), to the main expansion means (170) and a cold branch (15Of) connected, upstream, to an expansion means (142, 144) mounted on a branch (146) of the line (145) and, downstream, to a turbine portion (162) of the turbocompressor unit (160). The invention also relates to a method for circulating a refrigerating fluid inside the abovementioned device.

10 Claims, 3 Drawing Sheets

(56) References Cited

U.S. PATENT DOCUMENTS

| | | | | |
|---|---|---|---|---|
| 6,644,045 | B1 * | 11/2003 | Tang et al. | 62/116 |
| 6,694,750 | B1 * | 2/2004 | Lifson et al. | 62/113 |
| 7,694,528 | B2 * | 4/2010 | Nishida et al. | 62/500 |
| 2006/0230765 | A1 * | 10/2006 | Fedorov et al. | 62/5 |
| 2007/0193301 | A1 * | 8/2007 | Andres | 62/498 |
| 2010/0031677 | A1 * | 2/2010 | Lifson et al. | 62/113 |
| 2010/0223939 | A1 * | 9/2010 | Mitra et al. | 62/117 |

FOREIGN PATENT DOCUMENTS

| | | | |
|---|---|---|---|
| EP | 1775531 | A1 | 4/2007 |
| GB | 2086024 | A | 5/1982 |
| JP | 2002-061975 | | 2/2002 |
| JP | 2004-183913 | | 7/2004 |
| JP | 2004-325019 | | 11/2004 |
| JP | 2006-284085 | | 10/2006 |
| SU | 1776939 | A1 | 11/1992 |

* cited by examiner

REFRIGERATING DEVICE AND METHOD FOR CIRCULATING A REFRIGERATING FLUID ASSOCIATED WITH IT

CROSS-REFERENCE TO RELATED APPLICATIONS

This application is a 35 USC §371 application of International Application No. PCT/IT2007/000360 filed May 22, 2007, which is hereby incorporated by reference in its entirety.

TECHNICAL FIELD OF THE INVENTION

The present invention relates to a refrigerating device, in particular suitable for circulating a fluid in industrial refrigerating plants as well as in household air-conditioning systems, and to a method for circulating a refrigerating fluid associated with it.

DESCRIPTION OF THE PRIOR ART

In general, a device for circulating a refrigerating fluid includes a compressor designed to compress the refrigerant in the gaseous state, giving it a higher temperature and pressure value; a condenser able to condense the compressed gaseous refrigerant with consequent conversion thereof into the liquid state and release of heat to the external environment; an expansion unit, for example a capillary tube or an isoenthalpic throttling valve, intended to lower the temperature and the pressure of the refrigerant; and an evaporator, which absorbs heat from the external environment, cooling it, and transfers it to the refrigerating fluid at a low temperature and pressure received from the expansion unit, said fluid passing from the liquid state into the vapour state.

During recent years many attempts have been made to increase the performance of the refrigerating devices. Some have encountered obstacles of a technological nature, which have prejudiced the feasibility thereof, while others have brought advantages in terms of increased efficiency, while significantly complicating, however, the plant. An example in this connection consists of dual-stage compression plants where the existence of two independent compressors causes problems of balancing of the loads and more complex management of the entire plant.

The object of the present invention is to eliminate, or at least reduce, the drawbacks mentioned above, by providing a refrigerating device and a method for circulating refrigerating fluid associated with it, which are improved in terms of efficiency.

According to a first aspect of the present invention, a refrigerating device comprising a main compressor, a condenser downstream of and in fluid communication with said main compressor, main expansion means downstream of said condenser and an evaporator downstream of and in fluid communication with said main expansion means is provided, characterized in that it comprises a turbocompressor unit connected between said evaporator and said main compressor and at least one heat exchanger having a hot branch connected upstream, via an inlet line, to said condenser and downstream, via an outlet line, to said main expansion means and a cold branch connected, upstream, to an expansion means mounted on a branch of said inlet line and, downstream, to a turbine portion of said turbocompressor unit.

According to another aspect of the present invention a method for circulating a refrigerating fluid inside a device according to the invention is provided, said method comprising the stages of:

compressing the refrigerating fluid in a main compressor;

condensing the fluid in a condenser downstream of and in fluid communication with said main compressor;

expanding the fluid in main expansion means downstream of said condenser;

evaporating the fluid in an evaporator downstream of and in fluid communication with said main expansion means;

characterized in that it comprises between said condensation stage and said expansion stage at least one stage involving heat exchange stage, inside at least one heat exchanger, between the compressed refrigerating fluid, which flows inside a hot branch of the heat exchanger, and an associated amount of compressed refrigerating fluid withdrawn upstream of the heat exchanger, cooled inside an expansion means and flowing inside a cold branch of the heat exchanger; and between said main expansion stage and said main compression stage, a stage involving pre-compression of the refrigerating fluid inside a turbocompressor unit, said pre-compression stage comprising at least one stage involving expansion, inside at least one turbine portion of the turbocompressor unit, of the bled-off refrigerating fluid leaving the cold branch of the heat exchanger.

BRIEF DESCRIPTION OF THE DRAWINGS

Characteristic features and advantages of the present invention will emerge more clearly from the following detailed description of a currently preferred example of embodiment thereof, provided solely by way of a non-limiting example, with reference to the accompanying drawings, in which.

In the accompanying drawings, identical or similar parts and components are indicated by the same reference numbers.

DETAILED DESCRIPTION OF THE PREFERRED EMBODIMENTS

Figure 1:
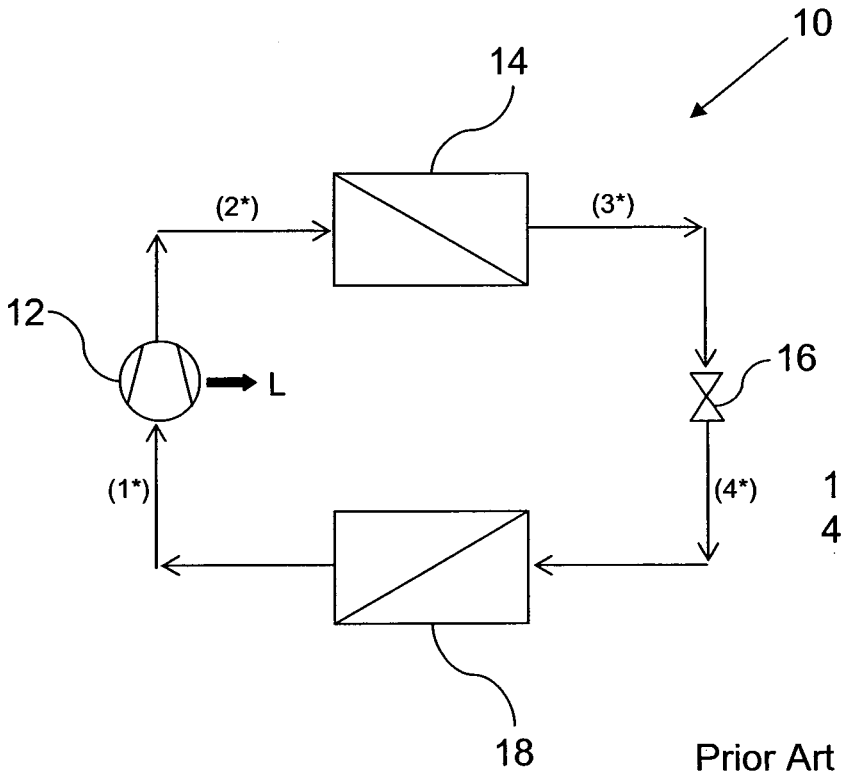
FIG. 1 is a schematic view, which shows a refrigerating device according to the prior art.
Figure 2:
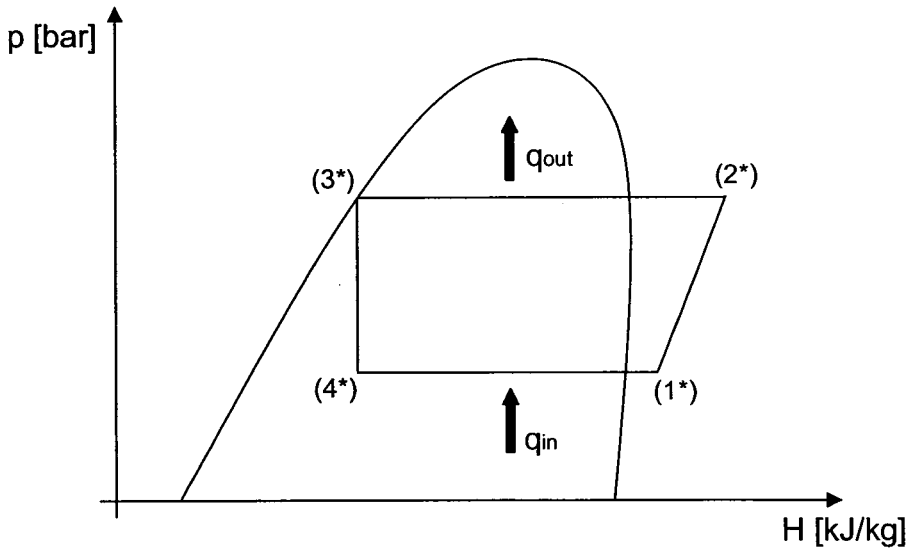
Prior Art Fig. 2
FIG. 2 shows the pressure-enthalpy diagram for the refrigerating fluid circulating inside the device of FIG. 1.

FIGS. 1 and 2 show, respectively, a refrigerating device 10 of the conventional type, which is particularly suitable for freezing alimentary products, and the p-h (pressure-enthalpy) diagram for the fluid circulating inside it. As shown, the device 10 is formed by a compressor 12, by a condenser 14 in fluid communication with the compressor 12, by an isoenthalpic throttling valve 16 in fluid communication with the condenser 14 and by an evaporator in fluid communication with the throttling valve 16, upstream, and with the compressor 12 downstream.

The refrigerating fluid, for example freon, enters into the compressor 12 in the form of superheated vapour at a low temperature and pressure, for example −35° C. and 1.33 bar (point 1* in p-h diagram), is compressed and enters into the condenser 14 at a high pressure and temperature, for example +65° C. and 16 bar (point 2* in p-h diagram). Inside the condenser 14 the refrigerating fluid undergoes cooling, passing from the superheated vapour state (point 2*) into the liquid state (point 3* in p-h diagram) and releasing a quantity of heat $q_{out}$ to the external environment. The refrigerating fluid in the liquid state, leaving the condenser 14, expands passing through the isoenthalpic throttling valve 16 and undergoing a reduction in pressure without exchanging heat with the external environment (isoenthalpic conversion). The fluid leaving the throttling member (point 4* in p-h diagram) enters into the evaporator, where it passes from the liquid state into the superheated vapour state (point 1* in p-h diagram) absorbing a quantity of heat $q_{in}$ from the external environment.

Figure 3:
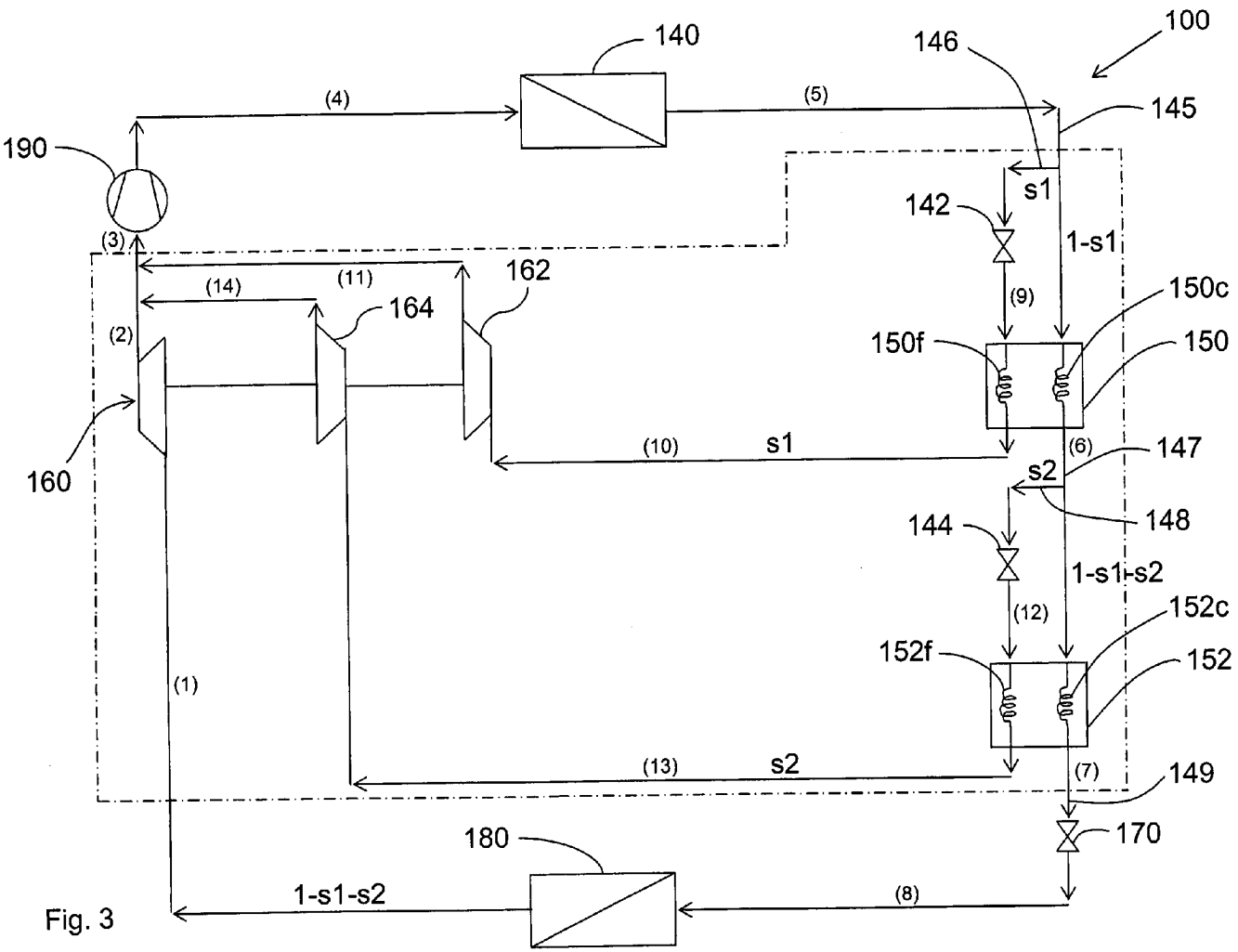
FIG. 3 is a schematic view of a refrigerating device according to the present invention.

With reference to FIG. 3, which shows a preferred embodiment of the present invention, a device for circulating a refrigerating fluid, denoted generally by the reference number 100, is formed by the components of a conventional refrigerating device, namely a main condenser 140, main expansion means such as a main isoenthalpic throttling valve 170, an evaporator 180 and a main compressor 190.

The aforementioned conventional device is supplemented with certain components, enclosed ideally within a block—defined by broken lines in FIG. 3—which comprises a first and a second heat exchanger, 150, 152, respectively, for example heat exchangers of the plate or tube-bundle type, commonly used in the refrigerating sector, arranged in series between the condenser 140 and the main throttling valve 170, and a turbocompressor unit 160, inserted between the main compressor 190 and the evaporator 180 and provided with a compressor portion 166 and a first and second turbine portion 162, 164, which are respectively supplied by an outlet of each heat exchanger 150, 152.

More particularly the condenser 140 is connected, via an inlet line 145, to a circuit for refrigerating fluid at a higher temperature, referred to below as "hot branch" 150*c*, of the first heat exchanger 150. The inlet line 145 has, branched off it, a line 146 which incorporates first expansion means, for example a first throttling valve 142, which leads into a circuit for a refrigerating fluid at a lower temperature, referred to below as "cold branch" 150*f*, of the first heat exchanger 150. The outlet of the hot branch 150*c* of the first heat exchanger 150 is linked, via a connection line 147, to the inlet of a circuit for refrigerating fluid at a higher temperature, referred to below as "hot branch" 152*c*, of the second heat exchanger 152, while the outlet of the cold branch 150*f* of the first heat exchanger 150 is connected to the inlet of the first turbine portion 162 of the turbocompressor unit 160.

The line 147 connecting together the first and the second heat exchanger 150, 152 has a branch 148 provided with second expansion means, for example a second throttling valve 144, which leads into a circuit for refrigerating fluid at a lower temperature, referred to below as "cold branch" 152*f*, of the second heat exchanger 152. The outlet of the hot branch 152*c* of the second heat exchanger is connected, via an outlet line 149, to the main throttling valve 170, while the outlet of the cold branch 152*f* is connected to the inlet of the second turbine portion 164 of the turbocompressor unit 160.

The outlet of the evaporator 180 is connected to the inlet of the compressor portion 166 of the turbocompressor unit 160, the outlet of which is in fluid communication with the main compressor 190.

Below the operating principle of the device according to FIG. 3 will be described with reference to the p-h diagram relating to the refrigerating fluid circulating through it, shown in FIG. 4. In the particular example in question, the refrigerating device is used for rapid freezing of alimentary products. For this purpose, the temperatures of the fluid circulating inside the device vary between a value $T_{min}$=−40° C. and a value $T_{max}$=63.7° C. and the refrigerating fluid chosen is freon. It is understood that the refrigerating device according to the present invention is suitable for many applications, for example the air-conditioning of domestic premises, so that, depending on the intended use, the pressure and temperature values of the physical states 1-14, as well as the type of refrigerating fluid circulating inside the device, will vary correspondingly.

Refrigerating fluid, typically freon, at a temperature $T_5$=35° C. and pressure $p_5$=16.1 bar (point 5 in p-h diagram), namely in a liquid/vapour equilibrium state, flows out from the condenser 140. A portion of the refrigerating fluid flowing out from the condenser 140, referred to below as first bleed-off s1, is conveyed, via the branch 146 of the line 145 into the first isoenthalpic throttling valve 142, where it is cooled down to a temperature ranging between the maximum temperature ($T_{max}$=35° C.) and the minimum temperature ($T_{min}$=−35° C.) of the cycle, preferably a temperature $T_9$=7° C. (point 9 in p-h diagram; $p_9$=7.48 bar) and then into the cold branch 150*f* of the first heat exchanger 150, while the remaining portion 1-*s*1 of refrigerating fluid enters directly into the cold branch 150*c* of the heat exchanger 150 at the temperature $T_5$ and at the pressure $p_5$.

Inside the first heat exchanger 150, the refrigerating fluid portion contained in the hot branch 150*c* transfers heat to the refrigerating fluid portion contained in the cold branch 150*f*, being cooled from $T_5$=35° C. to a temperature $T_6$=12° C., and entering the subcooled liquid zone of the p-h diagram (point 6; $p_6$=16.1 bar), while the refrigerating fluid portion contained in the cold branch 150*f* absorbs heat from the refrigerating fluid portion contained in the hot branch 150*c*, being heated from $T_9$=7° C. to a temperature $T_{10}$=12° C. and entering the superheated vapour zone of the p-h diagram (point 10; $p_{10}$=7.48 bar).

Downstream of the first heat exchanger 150 a second amount of refrigerating fluid is bled off, so that a portion s2 of the subcooled liquid leaving the hot branch 150*c* passes through the second isoenthalpic throttling valve 144, where it is further cooled from the temperature $T_6$=12° C. to a temperature $T_{12}$=−17° C. (point 12 in p-h diagram; $p_{12}$=3.38 bar) and then into the cold branch 152*f* of the second heat exchanger 152, while the remaining portion 1-*s*1-*s*2 of the refrigerating fluid leaving the heat exchanger 150 enters into the hot branch 152*c* of the second heat exchanger 152 at the temperature $T_6$ and pressure $p_6$.

Figure 4:
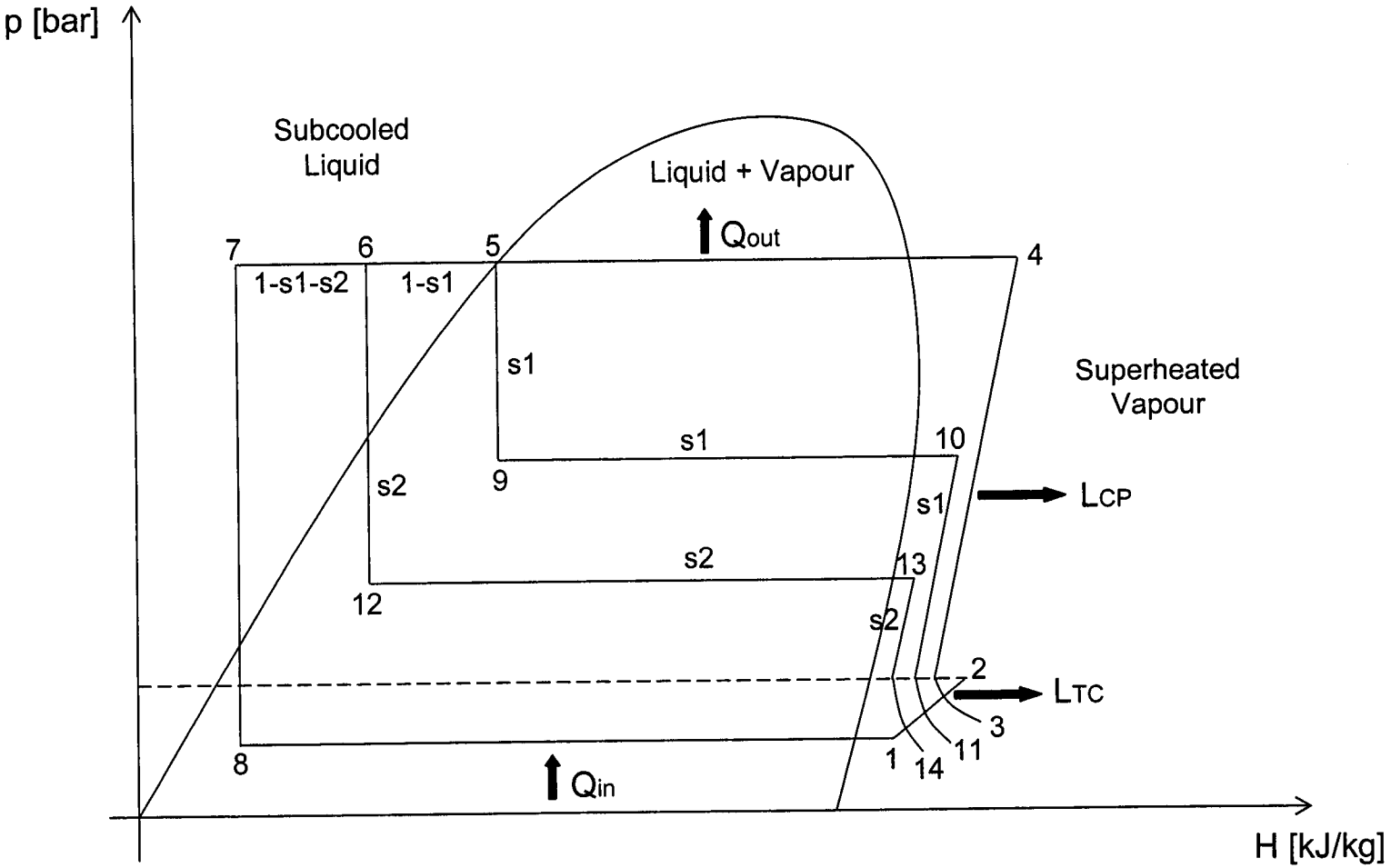
FIG. 4 shows the pressure-enthalpy diagram for the refrigerating fluid circulating inside the device of FIG. 3.

Inside the second heat exchanger 152, the portion of refrigerating fluid contained in the hot branch 152*c* releases heat to the refrigerating fluid portion contained in the cold branch 152*f*, cooling from $T_6$=12° C. to a temperature $T_7$=−12° C. and moving further to the left, in the diagram of FIG. 4, into the subcooled liquid zone (point 7 in p-h diagram; $p_7$=16.1 bar), while the refrigerating fluid portion contained in the cold branch 152*f* absorbs heat from the refrigerating fluid portion contained in the hot branch 152*c*, being heated from $T_{12}$=−17° C. to a temperature $T_{13}$=−12° C. and entering the superheated vapour zone of the p-h diagram (point 13; $p_{13}$=3.38 bar).

The first and second bleed-offs of refrigerating fluid s1, s2 leaving each heat exchanger 150, 152 in the form of refrigerating fluid in the superheated vapour state are introduced, respectively, into the first and second turbine portion 162, 164 of the turbocompressor unit 160. Inside the first turbine portion 162, the refrigerating fluid undergoes expansion, passing from a pressure $p_{10}$=7.48 bar ($T_{10}$=12° C.) to a pressure $p_{11}$=2.03 bar ($T_{11}$=−25° C.); similarly, inside the second turbine portion 164 the refrigerating fluid will undergo expansion passing from a pressure $p_{13}$=3.38 bar ($T_{13}$=−12° C.) to a pressure $p_{14}$=2.3 bar ($T_{14}$=−25.6° C.).

The portion of refrigerating fluid 1-*s*1-*s*2 leaving the hot branch 152*c* of the second heat exchanger 152 (point 7 in p-h diagram) enters into the main throttling valve 170, cooling from $T_7$=−12° C. to a temperature $T_8$=−40° C. (point 8 in p-h diagram; $p_8$=1.33 bar) and then into the evaporator 180, where it passes from the liquid+vapour state to the superheated vapour state (point 1 in p-h diagram), absorbing a quantity of heat $Q_{in}$ from the external environment. The refrigerating fluid in the superheated vapour state leaving the evaporator 180 enters into the compressor portion 166 of the turbocompressor unit 160.

The compressor 166, operated by the turbines 162, 164 hosting, inside them, the conversion, into mechanical energy, of the kinetic energy contained in the bled-off refrigerating fluid s1 and s2 in the superheated vapour state supplied by the first and second heat exchanger 150, 152, performs pre-compression of the refrigerating fluid supplied by the evaporator 180 (point 3 in p-h diagram; T3=−22.1° C., p3=2.03 bar), before its entry into the main compressor 190.

This pre-compression stage offers considerable advantages. Firstly, since the mechanical energy is supplied by the bleed-offs s1, s2 which expand inside the turbines 162, 164, it is not required to use an external energy source. Secondly, the turbocompressor unit 160 compresses the refrigerating fluid, performing the work $L_{TC}$ (FIG. 4), when it is in the maximum specific volume condition, so that the main compressor 190 does not perform that part of the work which, in view of its constructional characteristics, penalizes its efficiency and in particular its processable mass flow, with a consequent reduction in the electric energy supplying the compressor itself. Again, the turbocompressor unit 160 has a fluid/dynamic connection with the main compressor 190 with the possibility of being able to adapt independently to the different load conditions without the aid of external control. Finally, it is important to mention the fact that cooling of the refrigerating fluid produced in the heat exchangers 150, 152 causes an increase in the performance of the evaporator 180, despite the fact that, following the bleed-offs s1, s2 there is, at the same time, a simultaneous reduction in the flow of refrigerating fluid into the evaporator 180.

The refrigerating fluid pre-compressed in turbocompressor unit 160 enters into the main compressor 190, where it is compressed to a pressure $p_4$=16.1 bar (point 4 in p-h diagram; $T_4$=63.7), and then conveyed to the inlet of the condenser 140.

It has been found that, with a device for circulating refrigerating fluid according to the present invention, namely comprising a pre-compression stage performed by a turbocompressor unit, it is possible to achieve a coefficient of performance (COP), defined as the ratio between the heat Q drawn from the lower temperature source, which constitutes the "amount of cold" produced and the work L expended in order to cause operation of the device for circulating a refrigerating fluid, which is greater than that of a conventional device of the type illustrated in FIGS. 1 and 2.

In particular, assuming the pressures of the bleed-offs s1 and s2 to be, respectively, of $p_9$=7.48 bar and $p_{12}$=3.38 bar, a minimum temperature gradient $\Delta T_{min}$=5° C. in the heat exchangers 150, 152, an efficiency $\eta_T$=0.85 of the first and second turbine portion 162, 164, an efficiency $\eta_C$=0.80 of the compressor portion 166 and an efficiency $\eta_{CP}$=0.75 of the main compressor 190, the pressure values (p), temperature values (T) and enthalpy values (h) are obtained for the physical states 1-14 of the p-h diagram according to FIG. 4, shown in the following Table 1:

TABLE 1

| Physical State | p [bar] | T [° C.] | h [Kj/Kg] |
|---|---|---|---|
| 1 | 1.33 | −35 | 347.6 |
| 2 | 2.03 | −20 | 358.1 |
| 3 | 2.03 | −22.1 | 356.6 |
| 4 | 16.1 | 63.7 | 415.0 |
| 5 | 16.1 | 35 | 254.8 |
| 6 | 16.1 | 12 | 217.5 |
| 7 | 16.1 | −12 | 183.4 |
| 8 | 1.33 | −40 | 183.4 |
| 9 | 7.48 | 7 | 254.8 |
| 10 | 7.48 | 12 | 376.7 |
| 11 | 2.03 | −25 | 354.3 |
| 12 | 3.38 | −17 | 217.5 |
| 13 | 3.38 | −12 | 362.5 |
| 14 | 2.03 | −25.6 | 353.8 |

The coefficient of performance COP is defined, in general, as the ratio between the heat Q subtracted from the lower temperature source, which constitutes the "amount of cold" produced, and the work L expended to cause operation of the refrigerating fluid circulation device. In particular, the COP is defined by the ratio between the heat $Q_{in}$ subtracted from the external environment by the evaporator 180 and the work $L_{CP}$ performed by the main compressor 190, namely:

$$Q_{in}=(1-s1-s2)\times(h1-h7)$$

and $$L_{CP}=h4-h2$$

From which, based on the values shown in Table 1, the following is obtained:

$$COP=\frac{Q_{in}}{L_{CP}}=1{,}74$$

Table 2 below summarises the typical pressure, temperature and enthalpy values of a refrigerating fluid circulating inside a conventional refrigeration device of the type illustrated in FIGS. 1 and 2.

TABLE 2

| Physical State | p [bar] | T [° C.] | h [Kj/Kg] |
|---|---|---|---|
| 1 | 1.33 | −35 | 347.6 |
| 2 | 16.1 | 65.3 | 416.9 |
| 3 | 16.1 | 35 | 254.8 |
| 4 | 1.33 | −40 | 254.8 |

This gives:

$$q_{in}=(h1-h4)$$

and $$L_{CP}=h2-h1$$

from which, based on the values shown in Table 2, the following is obtained:

$$COP_{ST}=\frac{q_{in}}{L_{CP}}=1{,}34$$

The percentage benefit Δ of the novel refrigerating device compared to a refrigerating device of the conventional type is:

$$\Delta = \frac{COP - COP_{ST}}{COP_{ST}} \cong 30\%$$

From the description provided hitherto it is possible to state that a refrigerating device according to the present invention, owing to the presence of the turbocompressor unit 160 and the consequent pre-compression of the refrigerating fluid circulating inside the device upstream of the main compressor 190, allows an increase in performance equal to about 30% to be obtained, all of which without the need for power supplied externally, but advantageously using the mechanical energy provided by one or more turbine portions 162, 164 of the turbocompressor unit 160, obtained by causing the expansion of one or more amounts s1, s2 of refrigerating fluid bled-off downstream of the condenser 140.

Although the invention has been described with reference to a preferred example thereof, persons skilled in the art will understand that it is possible to apply numerous modifications and variations thereto, all of which fall within the scope of protection defined by the accompanying claims. For example, instead of two heat exchangers and turbocompressor unit with two turbines, it is possible to use a single heat exchanger and a turbocompressor unit with a single turbine. In this specific case, the single heat exchanger will have the hot branch connected between the condenser and the main throttling valve and the cold branch in fluid communication with the inlet of the single turbine portion of the turbocompressor. Moreover, instead of a turbocompressor unit having multiple turbine portions, it is possible to envisage a plurality of turbocompressors each with a single turbine portion.

The invention claimed is:

1. A refrigerating device comprising:

a main compressor;

a condenser downstream of and in fluid communication with said main compressor;

main expansion means downstream of said condenser;

an evaporator downstream of and in fluid communication with said main expansion means; and a turbocompressor unit in fluid communication between said evaporator and said main compressor and in fluid communication with at least one heat exchanger, said at least one heat exchanger having:

a hot branch connected upstream, via an inlet line, to said condenser and downstream, via an outlet line, to said main expansion means; and a cold branch connected, upstream, to an expansion means mounted on a branch of said inlet line to said condenser and connected, downstream, to a turbine portion of said turbocompressor unit, wherein said cold branch being connected downstream to said turbine portion enables fluid communication between said at least one heat exchanger and said turbocompressor unit.

2. The refrigerating device according to claim 1, wherein said at least one heat exchanger is a tube-bundle heat exchanger.

3. The refrigerating device according to claim 1, wherein said at least one heat exchanger is a plate-type heat exchanger.

4. The refrigerating device according to claim 1, wherein said main expansion means and said expansion means are isoenthalpic throttling valves.

5. The refrigerating device according to claim 1 further comprising a first and a second heat exchanger arranged in series between said condenser and said main expansion means, wherein said turbocompressor unit comprises a first and a second turbine portion, wherein said first heat exchanger comprises:

a first hot branch connected upstream, via a first inlet line, to said condenser and connected downstream, via a first outlet line, to said second heat exchanger; and a first cold branch, connected upstream to a first expansion means mounted on a first branch of said first inlet line to said condenser, and connected downstream to said first turbine portion of said turbocompressor unit, wherein said second heat exchanger comprises:

a second hot branch connected upstream, via a connection line, to said first hot branch of said first heat exchanger and connected downstream to said main expansion means; and a second cold branch connected, upstream, to a second expansion means mounted on a second branch of said connection line, and connected, downstream, to said second turbine portion of said turbocompressor unit.

6. A method for circulating a refrigerating fluid, the method comprising:

compressing the refrigerating fluid in a main compressor;

condensing the refrigerating fluid in a condenser downstream of and in fluid communication with said main compressor;

expanding the refrigerating fluid in main expansion means downstream of said condenser;

evaporating the refrigerating fluid in an evaporator downstream of and in fluid communication with said main expansion means;

between said condensation stage and said expansion stage, having at least one heat exchange stage involving a heat exchange inside at least one heat exchanger, said heat exchange being between the refrigerating fluid downstream from the condenser and an associated amount of the refrigerating fluid downstream from the condenser, said refrigerating fluid, downstream from the condenser, circulating inside a hot branch of said at least one heat exchanger, said associated amount circulating inside a cold branch of said at least one heat exchanger, wherein said associated amount is bled-off from the refrigerating fluid downstream from the condenser and is cooled inside an expansion means before flowing downstream into said cold branch of said at least one heat exchanger; and between said main expansion stage and said main compression stage, having a pre-compression stage involving pre-compression of the refrigerating fluid inside a turbocompressor unit, said pre-compression stage comprising at least one expansion stage involving expansion of the associated amount inside at least one turbine portion of the turbocompressor unit, the associated amount leaving the cold branch of said at least one heat exchanger to flow into said at least one turbine.

7. The method according to claim 6, wherein downstream of said at least one heat exchange stage between said condensation stage and said expansion stage further comprises:

a second heat exchange stage in a second heat exchanger arranged in series with the at least one heat exchanger, said second heat exchange stage involving a second heat exchange between the refrigerating fluid leaving the hot branch of the at least one heat exchanger and a second associated amount of the refrigerating fluid, said refrigerating fluid, from the hot branch of the at least one heat exchanger, circulating inside a second hot branch of said second heat exchanger, said second associated amount circulating inside a second cold branch of said second heat exchanger, wherein said second associated amount is bled-off said refrigerating fluid from the hot branch of the at least one heat exchanger and is cooled inside a second expansion means before flowing into said second cold branch, wherein said pre-compression stage, between said main expansion stage and said main compression stage, is powered by expansion of the associated amount leaving the cold branch of the at least one heat exchanger in a first turbine portion of said turbocompressor unit, and by the expansion of the second associated amount leaving the second cold branch of the second heat exchanger in a second turbine portion of said turbocompressor unit.

8. The refrigerating device according to claim 5, wherein each of said first and second heat exchanger is a tube-bundle heat exchanger.

9. The refrigerating device according to claim 5, wherein each of said first and second heat exchanger is a plate-type heat exchanger.

10. The refrigerating device according to claim 5, wherein said main expansion means, said first expansion means, and said second expansion means are isoenthalpic throttling valves.

* * * * *